United States Patent [19]

Moses

[11] 4,250,631

[45] Feb. 17, 1981

[54] TOBACCO-PIPE HOLDER AND DRYER

[76] Inventor: Leonard Moses, 1212 Elmwood, Pasadena, Tex. 77502

[21] Appl. No.: 6,094

[22] Filed: Jan. 24, 1979

[51] Int. Cl.[3] ..... F26B 9/00

[52] U.S. Cl. ..... 34/104; 34/239; 219/370

[58] Field of Search ..... 34/104, 106, 218, 239, 34/96; 219/368, 370, 373; 131/172, 178, 244

[56] References Cited

U.S. PATENT DOCUMENTS

| | | | |
|---|---|---|---|
| 2,809,441 | 10/1957 | Wasserlein | 34/104 |
| 2,861,163 | 11/1958 | Asakawa | 219/504 |
| 3,243,753 | 3/1966 | Kohler | 219/241 |
| 3,587,594 | 6/1971 | Keller | 34/104 |
| 3,786,576 | 1/1974 | Gavlick, Sr. | 34/104 |
| 3,943,329 | 3/1976 | Hlavac | 34/96 |
| 3,978,314 | 8/1976 | Shimizu | 34/97 |

*Primary Examiner*—Larry I. Schwartz
*Attorney, Agent, or Firm*—Neal J. Mosely

[57] ABSTRACT

A tobacco pipe holder and dryer comprises an enclosed, forced air circulation apparatus having means to support one or more pipes with the stems or shanks, thereof open to the exterior of the apparatus and having an arrangement of air jets for supplying heated air under forced air circulation into the bowls of the pipes supported therein. The apparatus includes an electric blower and electric heater means in the form of electric self-limiting strip heaters.

8 Claims, 6 Drawing Figures

TOBACCO-PIPE HOLDER AND DRYER

BACKGROUND OF THE INVENTION

1. Field of the Invention

This invention relates to new and useful improvements in pipe holders and, more particularly, to an improved dryer and holder for smoking pipes.

2. Brief Description of the Prior Art

It is well known that pipes tend to accummulate a substantial amount of fluid during use and often must be allowed to dry for an extended period between periods of use. Several attempts have been made at providing means for drying smoking pipes but these have involved complicated and in many cases, inefficient equipment.

Moore U.S. Pat. No. 2,447,084 discloses a smoking pipe holder and dryer in which the pipes are supported on a rack within an enclosure and are positioned with the pipe bowls facing downward over a convection heater.

Kravitt U.S. Pat. No. 2,488,087 discloses a pipe rack mounted on an electric lamp base so that pipes supported thereon would tend to be dried by convection currents of air when the light is illuminated.

Wolfe U.S. Pat. No. 3,056,412 discloses a holder for supporting tobacco pipes on an air vent window in an automobile to provide circulating air flowing over the pipe.

Ellison U.S. Pat. No. 3,640,001 discloses a tobacco pipe conditioning apparatus wherein the pipes are positioned within a vacuum container and provided with some heat by a lamp bulb to assist in drying the pipes stored in the apparatus.

SUMMARY OF THE INVENTION

It is one object of this invention to provide a new and improved apparatus for conditioning smoking pipes during the breaking in of the pipe and also to dry the pipes during further use thereof.

Another object of this invention is to provide a new and improved apparatus in form of a smoking pipe holder having a forced air circulation dryer associated therewith.

Another object of this invention is to provide a new and improved smoking pipe holder and dryer providing for forced circulation of heated air into the bowl of each pipe supported therein.

Still another object of this invention is to provide an improved smoking pipe holder and dryer which will accomodate types of varying sizes and shapes for storage and drying.

Other objects of this invention will become apparent from time to time throughout the specification and claims as hereinafter related.

A tobacco-pipe holder and dryer comprises an enclosed, forced air circulation apparatus having means to support one or more pipes with the stems thereof open to the exterior of the apparatus and having an arrangement of air jets for supplying heated air under forced air circulation into the bowls of the pipes supported therein. The apparatus includes an electric blower and electric heater means in the form of electric self-limiting strip heaters.

DESCRIPTION OF THE PREFERRED EMBODIMENT

Figure 1:
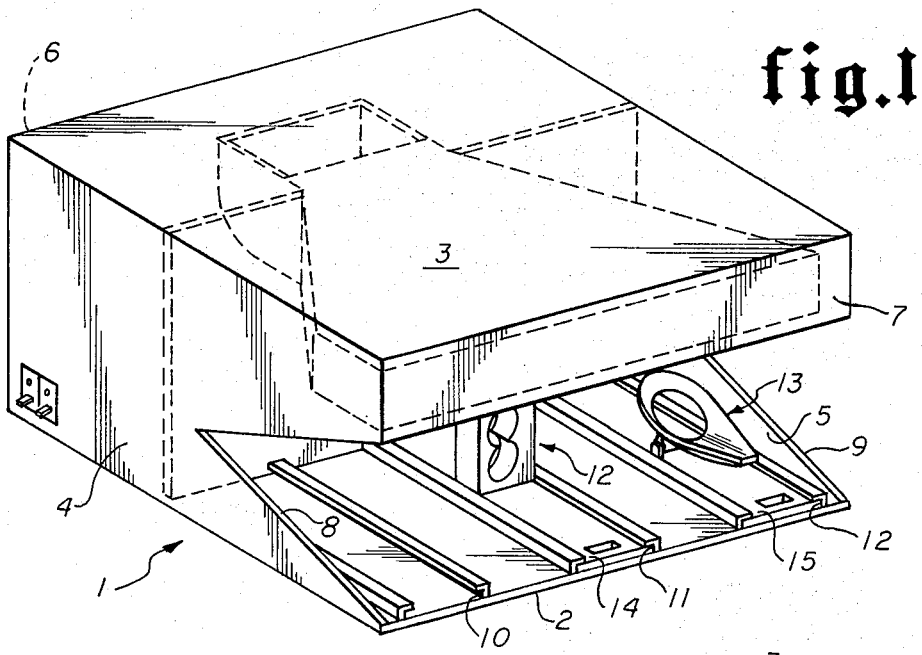
FIG. 1 is an isometric view of a preferred smoking pipe holder and dryer constructed in accordance with this invention.
Figure 2:
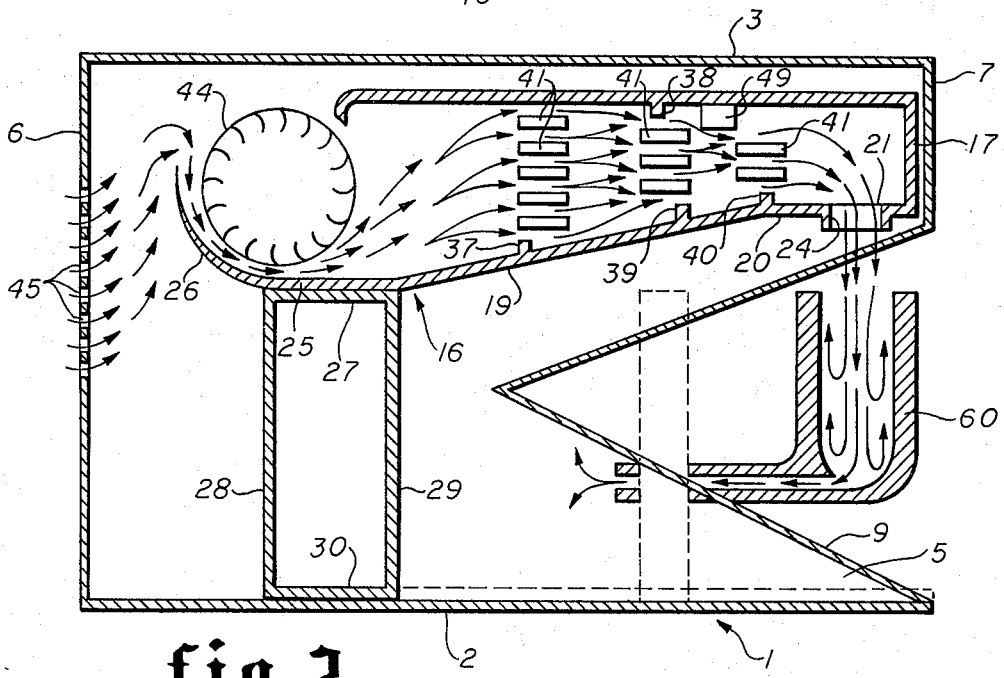
FIG. 2 is a view in left elevation of the apparatus shown in FIG. 1 with the left end wall removed.
Figure 3:
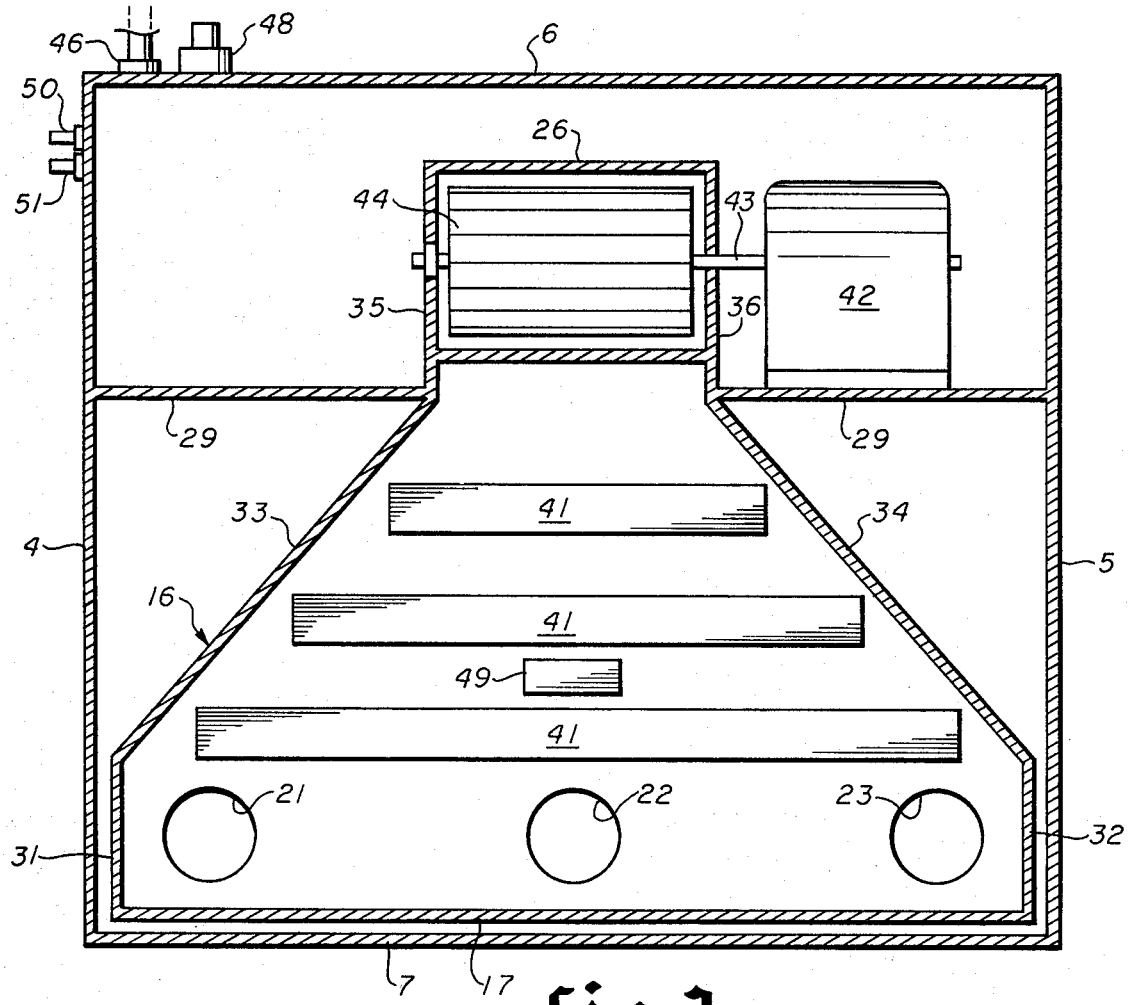
FIG. 3 is a plan view of the apparatus shown in FIG. 1 with the top wall removed.

Referring to the drawings by numerals of reference, and more particularly, to FIGS. 1–3, there is shown a preferred embodiment of the smoking pipe holder and drying apparatus which is provided with an external housing 1 having a bottom wall 2, top wall 3, end walls 4 and 5, rear wall 6 and front wall 7, respectively. Side walls 4 and 5 are cut out with enlarged V notches 8 and 9 therein which provide for ease of insertion and removal of pipes in the apparatus and provide an extended opening for circulation of air. The bottom wall 2 of the exterior housing 1 is provided with a plurality of slots 10, 11, and 12, respectively therein, which provides for insertion and removal of pipe holders 12 and 13 which provide for supporting pipes of various shapes in the apparatus, and for supporting pipes at different elevations in the apparatus. Pipe holders 12 and 13 are supported on supporting slabs 14 and 15 which slide in and are supported in the slots 10, 11 and 12.

In the upper portion of the apparatus, there is provided an internal housing generally designated 16. The configuration of housing 16 is seen more clearly by reference to FIGS. 2 and 3 of the drawing. In side elevation, housing 16 is elongated and somewhat rectangular in shape. Housing 16 has an end wall 17, top wall 18, and bottom wall 19. Bottom wall 19 tapers upward toward front wall 17 and terminates in flat wall portion 20 having a plurality of apertures 21, 22, and 23 therein, each of which have a sleeve or nozzle portion 24 which is arranged to direct air flow downward therefrom. The rear portion of bottom wall 16 terminates in flat wall portion 25 which merges with a curved upwardly extending wall 26. Rear wall portion 25 of bottom wall 19 is supported on and secured to the upper wall portion 27 of a box-shaped structure having side walls 28 and 29 and bottom wall 30.

In FIG. 3, interior housing 16 is shown to have short flat sidewall portions 31 and 32 which are spaced from side walls 4 and 5, respectively. Front wall portion 17 is, likewise, spaced from front wall 7 of the outer housing 1. Side walls 31 and 32 of inner housing 16 merge into and are integral with tapered side walls 33 and 34 which merge into and are integral with flat side walls 35 and 36.

Inner housing 16 is provided with a plurality of air baffles 37, 38, 39 and 40. There are also positioned within housing 16 a plurality of electric strip heaters 41, which are positioned to keep air circulating therethrough. Electric strip heaters 41 which are located rearwardly of the apparatus are the shortest heaters and a bank of five heater strips is provided. A bank of three somewhat longer strips heaters 41 is provided midway of housing 16 and two strips heaters 41 which are substantially longer are provided at the front end of housing 16 adjacent to apertures 21, 22, and 23.

Housing 16 is supported on a boxlike structure as previously described. Vertical wall 29 of said supporting boxlike structure merges into and is a part of a vertical wall extending across the entire width of the apparatus as seen in FIG. 3. On one side of the apparatus an electric motor 42 is supported on wall 29 and is connected by drive shaft 43 to squirrel cage blower 44. Shaft 43 for motor 42 and blower 44 is supported in walls 35 and 36 of housing 16. Blower 44 is spaced from curved rear wall 26 to provide an air inlet.

Air is permitted to enter the rear portion of the apparatus through a plurality of ventilating apertures 45 in rear wall 6. Also, air is permitted to circulate around inner housing 16 from the open front end of the apparatus through the air space between the walls of housing 16 and the walls of outer housing 1.

Figure 6:
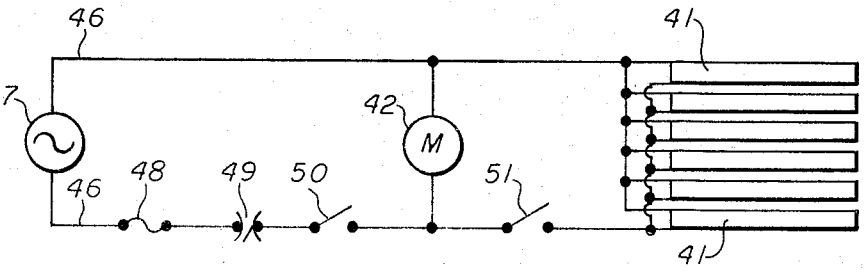
FIG. 6 is a wiring diagram for the electric motor and the heater coils used in the apparatus shown in FIG. 1.

In FIG. 6, there is shown a wiring diagram for the blower and heater circuits. Electric leads 46 are connected to electric current source 47 which may be a household current outlet. On one side, lead 46 is connected to fuse 48 which in turn is connected to bimetalic thermostatic switch 49. Switch 49 in turn is connected to master switch 50 and to heater switch 51. Motor 42 is connected to one of electric leads 46 on one side and on the other side is connected to the other electric lead 46 at a point between switches 50 and 51. Electric leads 46 are connected to strip heaters 41 which are connected in parallel therebetween. Electric strip heaters 41 are self-limiting heaters and are preferably AUTO-TRACE self-limiting heaters, manufactured by Chemelex Division of Raychem Corporation. The self-limiting strip heaters 41 are rated at eight watts per foot of length, and have a total length of three feet for all ten of the heater strips. These heaters are effective to maintain a constant air temperature of 225° F. Blower motor 42 is rated at 110 V, 2100 RPM, 75 watts, continuous duty rating. The physical location of fuse 46, bimetalic limit switch 49, master switch 50 and heater switch 51 is shown in FIGS. 1, 2 and 3.

Figure 4:
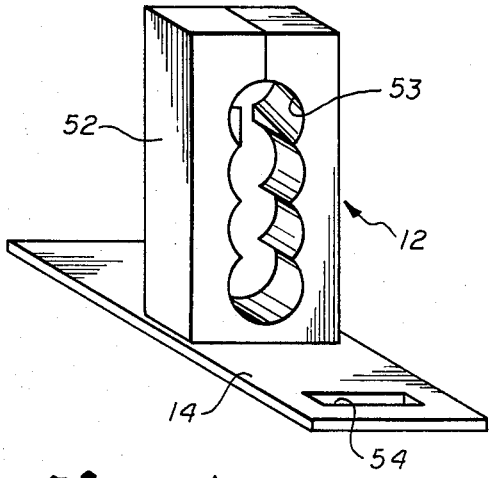
FIG. 4 is an isometric view of one of the pipe holders shown in FIG. 1.
Figure 5:
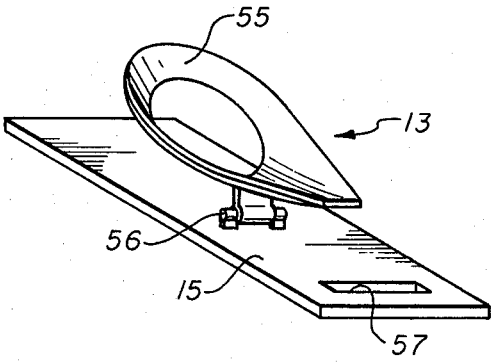
FIG. 5 is an isometric view of another one of the pipe holders shown in FIG. 1.

In FIGS. 4 and 5, there are shown isometric views of pipe holders 12 and 13 which illustrate in more detail two preferred holders. Pipe holder 12 has a vertically extending block portion 52 with a plurality of openings 53 therein at varying levels which will receive pipes of different shapes and also will support pipes at different vertical positions. Block 52 is supported on slab member 14 which slides in and is supported in any of the slots 10, 11 and 12 in base plate 2. Slab 14 may have a notch 54 for ease of grasping the same for insertion and removal. Pipe holder 13 has a supporting member 55 which is pivotally supported as at 56. Supporting slab 15 for pivotally supported support 55 is also provided with a notched portion 57 for ease of insertion and removal in any of the supporting slots 10, 11, and 12. Pipe supports or holders of other shapes may be provided on suitable supporting slabs which are removably positioned in slots 10, 11 and 12.

OPERATION

The operation of this apparatus should be fairly apparent from the description of the various components and the mode of assembly. A more detailed description of operation, however, is provided to clarify any points left unanswered in the general description of construction.

Due to the moisture condensing into the bowl and stem of a smoking pipe, there is a need to dry the pipe in order to enhance smoking pleasure. This apparatus is designed to provide for rapid drying of smoking pipes.

The apparatus delivers warm, dry air under positive pressure to the bowl and shank or stem of the pipe as shown in FIG. 2 of the drawing. Air enters from the back of housing 1 through openings 45 and some air may be recirculated through the space between outer housing 1 and inner housing 16. The air is drawn into blower 44 which is operated by motor 42. The air circulates from blower 44 through electric heater strips 41. As noted above, there are a series of ten heater strips varying in length and which total about three feet in length. The strips are preferably rated at 0.1 ampere per foot and maintain a constant temperature of about 225° F. The blower 44 is rated at 110 V, 2100 RPM, 75 watts, continuous duty rating.

In FIGS. 4 and 5 there are shown two differently designed pipe holders 12 and 13. These are interchangeable and are held in slots 10, 11 and 12 in the base 2 of outer housing 1.

The air which flows through heaters 41 is circulated through openings or orifices 21, 22 and 23 and is directed into the bowl of a pipe 60 supported in or on one of the pipe holders.

The apparatus is provided with two switches, viz. master switch 50 and heater switch 51. Closing of master switch 50 allows motor 42 to drive blower 44. The closing of heater switch 51 energizes heater strips 41. This arrangement of switches makes it impossible to energize the heater strips 41 if the blower 44 is not energized. Bimetal limit switch 49 is positioned in series with switches 50 and 51 and opens the circuit to de-energize both the blower motor 42 and the heater strips 41 in the event the apparatus overheats. Switch 49 is positioned in the air stream and would normally function only if the heaters were energized and somehow the blower was not functioning. The system is also provided with fuse 48 which turns off the apparatus completely in the event of a circuit overload in the apparatus.

The apparatus is designed to dry three pipes simultaneously in approximately 20–30 minutes. The pipes, however, can remain installed with the apparatus operating continuously without damage to the pipes or to the apparatus. If desired, one or more of the orifices or apertures 21, 22 and 23 may be closed, by suitable closure means, in the event that only one or two of the orifices is to be used in the drying of a pipe.

While this invention has been described fully and completely, with emphasis on a preferred embodiment and illustrating the best mode of carrying out the invention, it should be understood that within the scope of the appended claims, the invention may be practiced otherwise than as specifically described herein.

I claim:

1. A tobacco smoking pipe holder and dryer comprising an outer housing enclosing a pipe-receiving chamber and having an enlarged unobstructed front opening for unobstructively receiving a pipe and having other openings for admission of air thereto, means to support a pipe with its bowl positioned upwardly in said chamber, blower means positioned in said housing for circulating air therein, an inner housing supported in spaced relation to said outer housing and having an inlet and an outlet end, said outlet end comprising at least opening positioned to direct the flow of heated air downward against the interior of the bowl of a pipe supported by said supporting means in said outer chamber housing, said blower means being positioned in said inlet end and operable to receive air from said air admission openings, electric heating means positioned within said housing within said inner housing to heat air circulating therethrough, switch means controlling energization of said blower means, switch means controlling energization of said heating means and operable to energize the same only when said blower switch means is closed, and thermostatic switch means operable to de-energize said blower means upon occurence of a predetermined temperature in said air-directing inner housing.

2. A tobacco smoking pipe holder and dryer according to claim 1 in which said outlet and opening includes a sleeve member positioned vertically to direct airflow in a jet downward against the interior of a pipe bowl supported in said outer housing.

3. A tobacco smoking pipe holder and dryer according to claim 1 in which said pipe supporting means comprises a pipe rack member removably supported in said outer housing.

4. A tobacco smoking pipe holder and dryer according to claim 1 in which said outlet end has a plurality of openings, each with a vertical sleeve portion directing airflow downward, and including a plurality of pipe rack members removably supported in said outer housing and operable to receive and support a pipe with its bowl aligned with a respective one of said sleeves so that heated air may be directed thereinto.

5. A tobacco smoking pipe holder and dryer according to claim 1 in which said electric heating means comprises at least one electric resistance heater positioned in said inner housing between the outlet end of said blower and said air outlet opening.

6. A tobacco smoking pipe holder and dryer according to claim 1 in which said blower means comprises a blower positioned in said inlet end and an electric motor for driving the same supported in said outer housing, and said electric heating means comprises at least one electric resistance heater positioned in said inner housing between the outlet end of said blower and said air outlet opening and connected in parallel with blower motor.

7. A tobacco smoking pipe holder and dryer according to claim 6 in which said blower switch means and said heating switch means are connected in series with said blower switch means controlling both said blower and said electric resistance heater and said heating switch means controlling only said electric resistance heater.

8. A tobacco smoking pipe holder and dryer according to claim 7 in which said thermostatic switch means is a bimetallic switch positioned in said inner housing adjacent to said electric resistance heaters and is connected in series with said blower switch means and said heating switch means.

* * * * *